US005084738A

United States Patent [19]

Ishikawa

[11] Patent Number: 5,084,738

[45] Date of Patent: Jan. 28, 1992

[54] FIXING APPARATUS

[75] Inventor: Noriyoshi Ishikawa, Yokohama, Japan

[73] Assignee: Canon Kabushiki Kaisha, Tokyo, Japan

[21] Appl. No.: 607,048

[22] Filed: Oct. 31, 1990

[30] Foreign Application Priority Data

Oct. 31, 1989 [JP] Japan ..... 1-284585
Oct. 31, 1989 [JP] Japan ..... 1-284586

[51] Int. Cl.[5] ..... G03G 15/20

[52] U.S. Cl. ..... 355/285; 219/216; 219/470; 355/289; 355/290

[58] Field of Search ..... 355/285, 292, 291, 295, 355/282; 219/216, 469, 470; 430/98, 124

[56] References Cited

U.S. PATENT DOCUMENTS

| | | | |
|---|---|---|---|
| 3,578,797 | 5/1971 | Hodges et al. | 219/388 X |
| 3,904,875 | 9/1975 | Rees et al. | 355/285 |
| 4,315,136 | 2/1982 | Block | 219/216 |
| 4,596,920 | 6/1986 | Inagaki | 219/216 |
| 4,611,902 | 9/1986 | Schön | 219/216 X |
| 4,711,549 | 12/1987 | Roodbeen | 219/216 X |
| 4,755,849 | 7/1988 | Tarumi et al. | 355/290 |
| 4,780,742 | 10/1988 | Takahashi et al. | 219/216 X |
| 4,907,016 | 3/1990 | Iwamatsu et al. | 219/216 X |
| 4,917,010 | 4/1990 | Gilham et al. | 219/216 X |
| 4,954,845 | 9/1990 | Yano et al. | 355/290 |
| 4,972,206 | 11/1990 | Matoushek | 219/216 X |
| 5,026,276 | 6/1991 | Hirabayashi et al. | 355/282 X |
| 5,027,160 | 6/1991 | Okada et al. | 355/282 |

FOREIGN PATENT DOCUMENTS

| | | | |
|---|---|---|---|
| 2921450 | 11/1979 | Fed. Rep. of Germany | 355/285 |
| 50-16936 | 6/1975 | Japan . | |
| 57-41672 | 3/1982 | Japan . | |
| 0187852 | 7/1989 | Japan | 355/289 |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

A fixing apparatus having an electrically conductive film which moves in contact with a recording material on which a picture image is held, a pressing roller for causing the film to be brought into contact with the recording material, and a plurality of electrodes disposed along a nip between the film and the pressing roller at a position opposing this pressing roller. The electrically conductive film heats up substantially only in the nip as the result of an electrical conductance to this electrode. An image on the recording material is heated and fixed by the heat generated by the electrically conductive film.

20 Claims, 10 Drawing Sheets

FIXING APPARATUS

BACKGROUND OF THE INVENTION

1. Field of the Invention

The present invention relates to a fixing apparatus which is used in a picture-image formation apparatus, such as copiers, electrophotographic printers and electro-static recording printers, for fixing a visible picture image on a recording material.

2. Description of the Related Art

In an apparatus for fixing a non-fixed picture image, wide use has been made of a thermal roller fixing method where a recording material having a non-fixed toner image thereon is heated by a heating roller maintained at a given temperature and a pressing roller having an elastic layer that presses against the heating roller while the recording material is being grasped and transported. A belt fixing apparatus is also known which is disclosed in U.S. Pat. Nos. 3,578,797 and 4,755,849 and in Japanese Patent Unexamined No. 50-16936 and Japanese Patent Examined No. 57-41672.

However, such heat fixing apparatus have problems due to the lengthy warm-up time required before the heating body is raised to a specified temperature. Hence, there has been proposed in an earlier Serial No. 206,767, assigned to the assignee of the present invention, a fixing apparatus in which the warm-up time is considerably reduced or eliminated by the use of a fixed heating body and a thin film. This fixing apparatus has excellent thermal response from the heating body since a thin film is not disposed between the heating body and the recording material. However, the thermal capacity is slightly larger by as much as the thin film.

SUMMARY OF THE INVENTION

An object of the present invention is to provide a fixing apparatus in which the warm-up time is very short.

Another object of the present invention is to provide a fixing apparatus whose power consumption is small.

A further object of the present invention is to provide a fixing apparatus in which a film which is brought into contact with a recording material heats up.

A still further object of the present invention is to provide a fixing apparatus in which an electrically conductive film is electrically charged by means of electrodes disposed within the width of a nip between a pressing member and the film.

In one embodiment, the fixing apparatus of the present invention includes an electrically conductive film that moves along with a recording material together with a pressing member that presses against this film to form a nip. A plurality of electrodes oppose the pressing member. The electrodes are disposed in a direction longitudinal to the nip and form a region between the electrodes wherein electric current is passed to the electrically conductive film resulting in the production of heat by that film. As the recording material passes through the nip, the image on the recording material is heated and fixed by the heat produced by the electrically conductive film.

In another embodiment of the fixing apparatus of this invention, there is included an electrically conductive film that moves along with a recording material containing an unfixed image. A plurality of electrodes are provided for supplying electricity to that film. The supply of electricity to the film causes it to produce and emit heat which in turn heats and fixes the image on the recording material. The electrodes are elongated and rotatingly mounted so as to rotate together with the recording material.

In still another aspect of the invention, there is provided a fixing apparatus that includes an electrically conductive film for moving along with a recording material and a pressing member that presses against the film and forms a nip between itself and the film. A plurality of electrodes are disposed in a longitudinal direction to the nip. The pressing member is of a predetermined width W1, the electrically conductive film is of a predetermined width W2 and the electrodes are of a predetermined length L. The relationship among the width of the film and pressing member and the length of the electrodes is such that W1 is less than W2 which is less than L.

These and other objects, features and advantages of the present invention will become clear when reference is made to the following description of the preferred embodiments of the present invention, together with reference to the accompanying drawings.

DESCRIPTION OF THE PREFERRED EMBODIMENTS

The embodiments of the present invention will be explained hereinunder with reference to the accompanying drawings.

Figure 1:
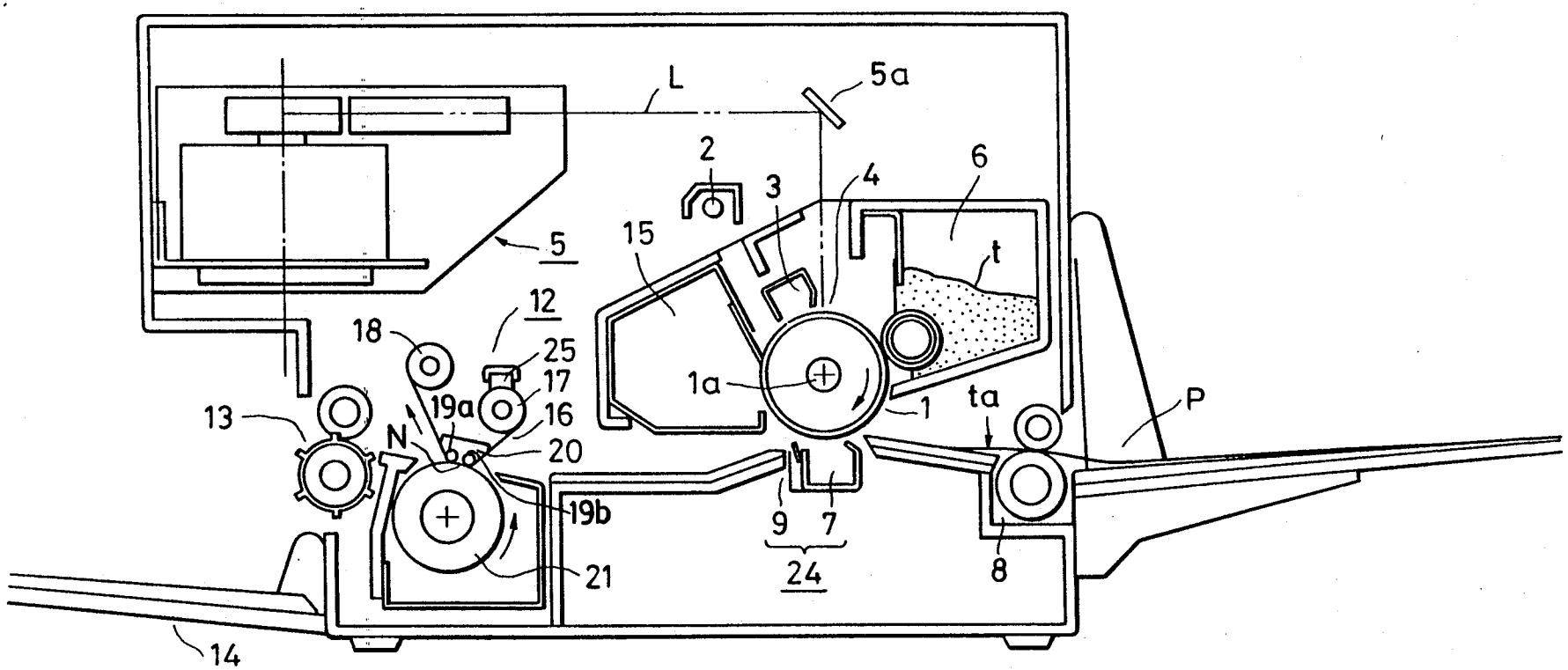
FIG. 1 is a schematic side elevational view illustrating a picture-image formation apparatus which includes a fixing apparatus comprising a first embodiment of the present invention.

FIG. 1 is a cross sectional view of a picture-image formation apparatus in which a fixing apparatus of an embodiment of the present invention is applied.

In FIG. 1, numeral 1 denotes a drum-type electrophotographic light-sensitive body (hereinafter referred to as a drum) which is driven to rotate at a predetermined peripheral velocity about a supporting axis 1*a* in the direction shown by an arrow, and being further provided with a light-sensitive body mainly composed of an organic or inorganic photoconductive layer on the peripheral surface of the drum-type base body.

During the rotation of the drum 1, it is subjected to uniform exposure over the entire surface by means of an eraser (entire surface exposure device) 2, and electrical charge is removed uniformly. Then, the drum 1 receives a uniform charge of a positive or negative specified potential by a primary charger 3. Then, the drum 1 receives the scanning writing of object picture-image information with a laser beam scanning exposure L by means of a laser scanner 5 in the exposure section 4. As a result, an electrostatic latent image corresponding to the object picture-image information is in sequence formed on the surface of the drum 1. Numeral 5*a* denotes a laser beam reflecting mirror for causing the laser beam L output from the laser scanner 5 to deflect to the exposure section 4 in the drum 1.

The latent image formed on the surface of the drum 1 is then made visible as a toner image by a powder development agent (toner) t by means of the development device 6.

Next, the toner image is transferred to the surface P of a sheet of transfer material, which is a recording material and which is caused to pass between the transfer charger 7 and the drum 1 from a paper feed mechanism 8 during the process in which the toner image passes the position of the transfer charger 7. The transferring of the toner image from the surface of the drum 1 to the surface P of the transfer material is performed by charging the toner picture image with a polarity reverse to the charging polarity by means of the transfer charger 7 disposed on the opposite side of the transfer material P.

The transfer material P which has passed the position above, the transfer charger 7 is then placed at a position beside the transfer charger 7. Before the transfer material P is introduced to a fixing apparatus 12, it is separated from the surface of the drum 1 by electrical charge removal by a removal needle 9 to which a potential of a polarity reverse to that of the charger is applied. A non-fixed toner image transferred to the surface of the transfer material P is fixed to the surface of the transfer material P as a permanent fixed image by the fixing apparatus. The transfer material on which an image is fixed is transported, as an image formed product, to a paper eject roller pair 13 and ejected onto a paper eject tray 14.

Meanwhile, after the toner image is transferred, deposited contaminants on the surface of the drum 1, such as transfer remaining toner, are removed by means of a cleaning apparatus 15, and the drum 1 is repeatedly used to form a picture image. Next, the fixing apparatus of an embodiment of the present invention will be explained.

Figure 2:
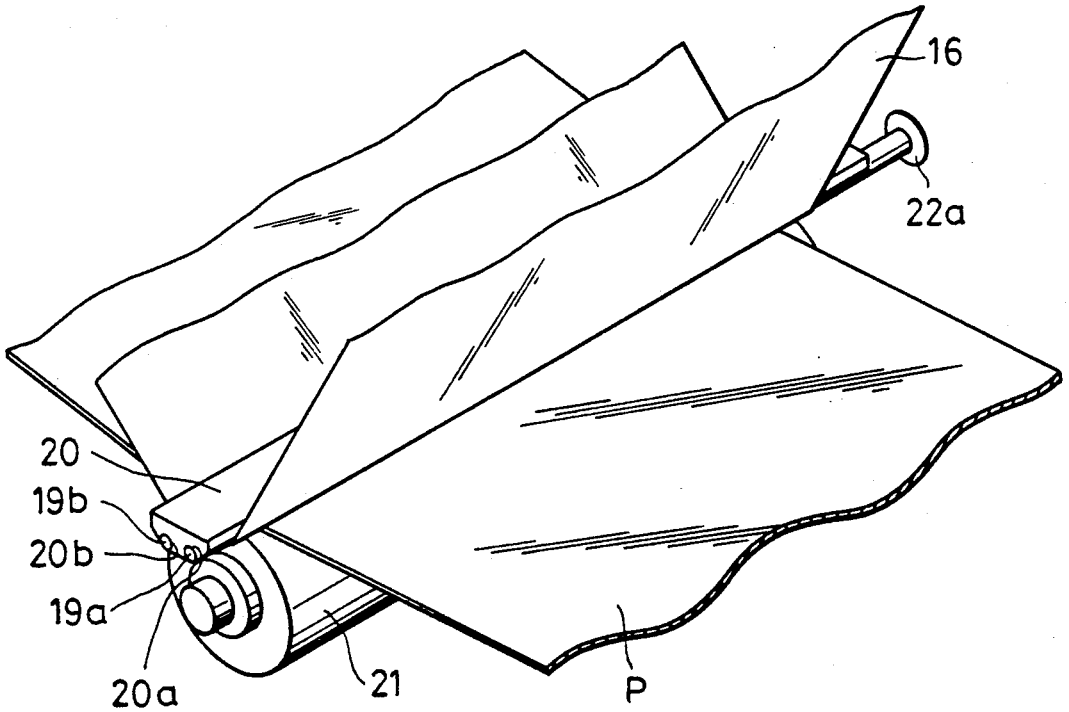
FIG. 2 is a partial perspective view illustrating the fixing apparatus FIG. 1.

FIG. 2 is a partial perspective view illustrating the fixing apparatus which is used in the apparatus in FIG. 1 in the embodiment of the present invention.

Reference numeral 16 denotes an electrically conductive fixing film which, as shown in FIG. 1, is wound around a take-up roller 18 and fed from a supply roll 17. The fixing film 16 passes between rod shaped electrodes 19*a* and 19*b* and pressing roller 21. The pressing roller 21 is urged against the fixing film 16 to form a nip N.

Figure 3:
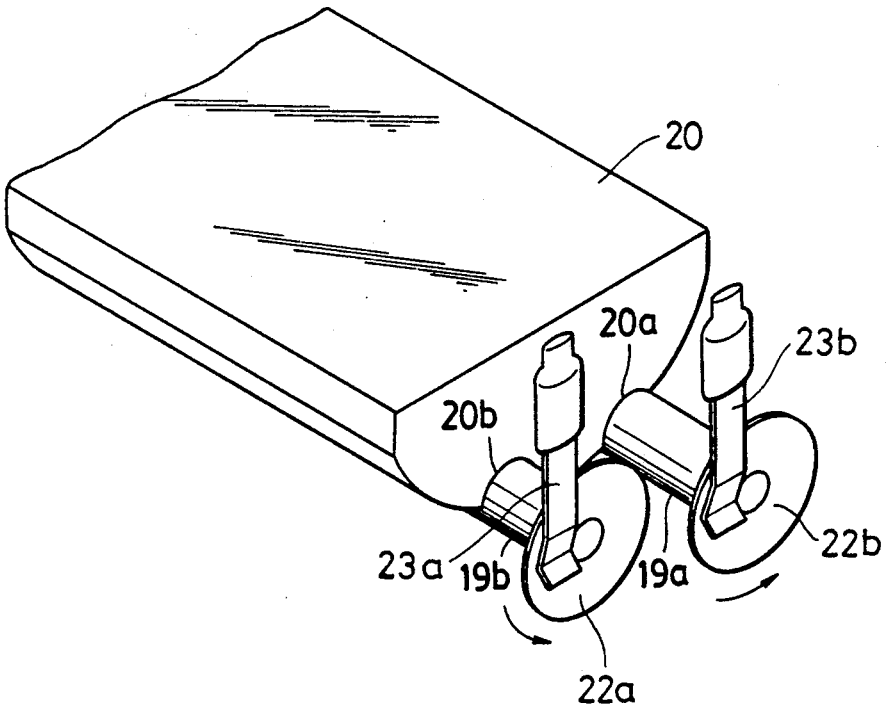
FIG. 3 is a perspective view of a slidable electrode section of the fixing apparatus of FIG. 2.

The supply roller 17 is provided with a conventional powder brake, etc., (not shown) that provides a predetermined tensile force to the fixing film 16. As shown in FIG. 3, the electrodes 19*a* and 19*b* are each rotatably held in the lower section of a non-conductive electrode holder 20 with the end portion of the electrodes extending beyond the end of the electrode holder 20, thereby exposing the electrodes in the lengthwise direction. The electrodes 19*a* and 19*b* are kept in contact with the fixing film 16 while keeping a conducting state at all times.

The take-up roller 18 is provided with a conventional powder clutch, etc., (not shown). The take-up roller 18 transports the fixing film 16 in the direction indicated by the arrow at a speed of approximately 110% to 180% with respect to the transport speed of the transfer material P toward the nip N while providing a predetermined tensile force. The fixing film 16 is transported so that it does not wrinkle or zigzag by the tensile force provided to it by the supply roller 17 and the take-up roller 18.

Reference numeral 21 denotes a pressing roller, as a pressing member, which has an outer rubber elastic layer made from a material having a high releasing characteristic, such as silicon rubber. A driving means (not shown) grasps, opposes and presses fixing film 16 against the electrodes 19*a* and 19*b* with an abutting pressure of 4 to 7 kgf. The fixing film 16 is driven to advance in the direction indicated by the arrow in FIG. 1 by an unillustrated driving means in synchronization with the transport speed of the transfer material P in the nip N. The fixing film 16 is supplied with electricity from an unillustrated power-supply circuit via the pair of electrodes 19*a* and 19*b* which are spaced apart and oppositely facing each other in the direction of transport of the transfer material P. The fixing film 16 is heated from the electric current passing through it, causing a non-fixed toner image on the transfer material closely in contact with the fixing film 16 to become molten. Therefore, the fixing film 16 should be made from materials having excellent resistance to heat and releasing characteristics, and the prescribed electrical characteristics.

Generally, the fixing film 16 should be of a thickness of 100 μm or less, preferably 40 μm or less. The fixing film 16 may be formed of a single-layer film or a composite layer film. Examples of suitable base materials include polyimide, polyamideimide, polyetherimide, high-impact polycarbonate, polycarbonate, or PFT (tetrafluoroethyleneperfluoroalkyl vinyl ether copolymer resin). The fixing film 16 may be coated, to a thickness of 10 μm, with a releasing coat layer composed of a fluororesin such as PTFE (tetrafluoroethylene resin) and PFA on the side of the selfheat-producing film in contact with a picture image.

The electrical characteristics of this electrically conductive fixing film 16 should preferably be 20 to 200 Ω·cm in volume resistivity. The surface resistance value, and in particular, the surface resistance value of the electrode side, should preferably be 200 to 1000Ω. Such electrical characteristics can be obtained by adding an electrically conductive material such as carbon black to heat-resistant resin.

The electrically conductive fixing film 16 produces Joule heat in a region between the electrodes 19*a* and 19*b* where current density is high. A required amount of heat will be provided to the toner in contact with the electrically conductive film and the transfer material P. The electrodes 19*a* and 19*b*, which are means for supplying electrical energy to the fixing film 16, are copper rods, approximately 1 to 2 mm in diameter, which are plated with platinum or rhodium. As shown in FIG. 3, electricalconductance electrode plates 22*a* and 22*b* are fixed to the back end of the pair of electrodes 19*a* and 19*b*. Sliding electrodes 23*a* and 23*b* are connected to and are supplied with a circuit from a power-supply circuit (not shown). These electrodes slidably contact the rotating electricalconductance electrode plates 22a and 22b, and suppy the plates with electrical current. A detailed perspective view of this sliding electrode section is shown in FIG. 3.

The electrode holder 20 holds the pair of electrodes 19a and 19b in recessed grooves 20a and 20b formed and spaced at a predetermined interval. Electrodes 19a and 19b are rotatable so that a part of the pair of electrodes 19a and 19b is exposed in the lengthwise direction. The electrode holder 20 is composed of an insulating resin such as PPS (polyphenylene sulfide), PAI (polyamideimide), PI (polyimide), PBT (polybutylene terephthalate) or unsaturated polyester, or it may be composed of a composite material of these above resins and ceramic, glass, etc.

Next, the fixing operation of the fixing apparatus in this embodiment will be explained.

The picture-image formation apparatus performs a prescribed picture-image formation operation in accordance with a picture-image formation start signal. Referring to FIG. 1, the transfer material P with a non-fixed toner image Ta carried on the top surface is transported a required distance from a transfer section 24 to a fixing apparatus 12. When the front end of the transfer material P reaches a predetermined position, e.g., approximately 15 mm in front of the fixing apparatus, the fixing film 16 begins to be transported. The transfer material P advances to the nip N where the electrodes 19a and 19b and the pressing roller 21 are pressed against each other, and it enters the nip between the fixing film 16 and the pressing roller 21. The non-fixed toner image Ta on the transfer material passes through the nip N, at the same velocity and in the same direction that the fixing film 16 is being transported. The transfer material P is in contact with the bottom surface of the fixing film 16 during movement through the fixing apparatus without causing a surface dislocation or wrinkles because of an overlap with the fixing film 16.

Figure 4:
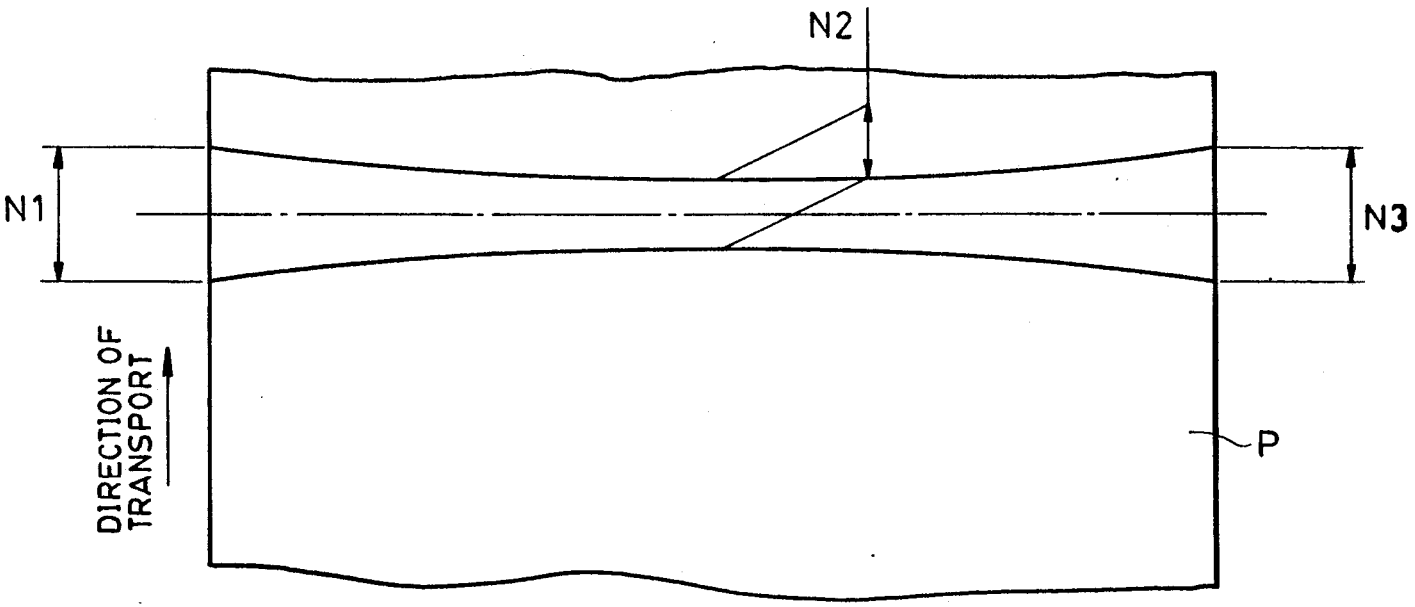
FIG. 4 is a top plan view illustrating the details of the fixing nip section of the end fixing apparatus of FIG. 2.

In this embodiment, the pressing roller 21 is formed of a metal shaft, 10 mm in diameter, that is coated with an approximately 4 mm silicon sponge layer having a rubber hardness of approximately 35° and further coated with an approximately 1 mm silicon sponge layer having a rubber hardness of approximately 45° therein. By applying a total pressure of approximately 5 kgf, the nip shape (N1=N3=5 mm, N2=4 mm) shown in FIG. 4 is obtained.

Figure 5:
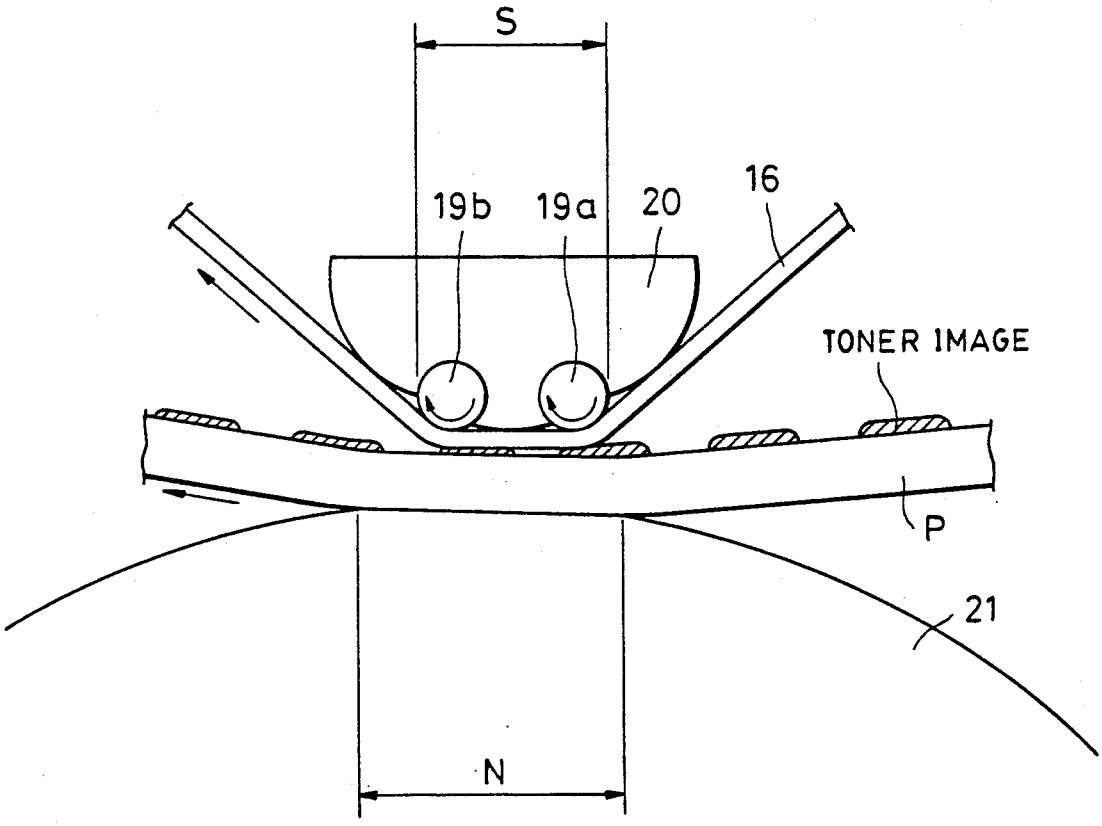
FIG. 5 is an enlarged view showing the electrode of the fixing apparatus of FIG. 2.

In FIG. 5, a character S indicates a spacing width dimension between the electrodes 19a and 19b. When this spacing width S is set at 3.5 mm, it places both electrodes within the region of width of the nip N in the transfer material surface. That is, the spacing width between the electrodes 19a and 19b is made narrower than the minimum width of the nip N.

During the process the toner image carried on the surface of the transfer material P passes the nip N whereupon it is pressed and contacted with the fixing film 16. The toner image becomes molten at the high temperatures produced by the fixing film 16 whereupon it is bonded to the surface of the transfer material P.

In this embodiment, the fixing film 16 includes approximately 35% carbon black in a PC (polycarbonate) base, is 20 μm thick, and has a volume resistance value of 70Ω·cm and a surface resistance value of 600 Ω was used. The electrical conductance between the electrodes 19a and 19b is controlled by a voltage of approximately 70 V, and the surface temperature of the fixing film 16 can reach approximately 140° C., a level sufficient for the prescribed fixing to be performed. Fixing can be accomplished without causing significant toner offset to the fixing film 16 by pressing against the fixing film 16 a felt pad 25 impregnated with silicon oil having a viscosity of approximately 10,000 cst.

Figure 6:
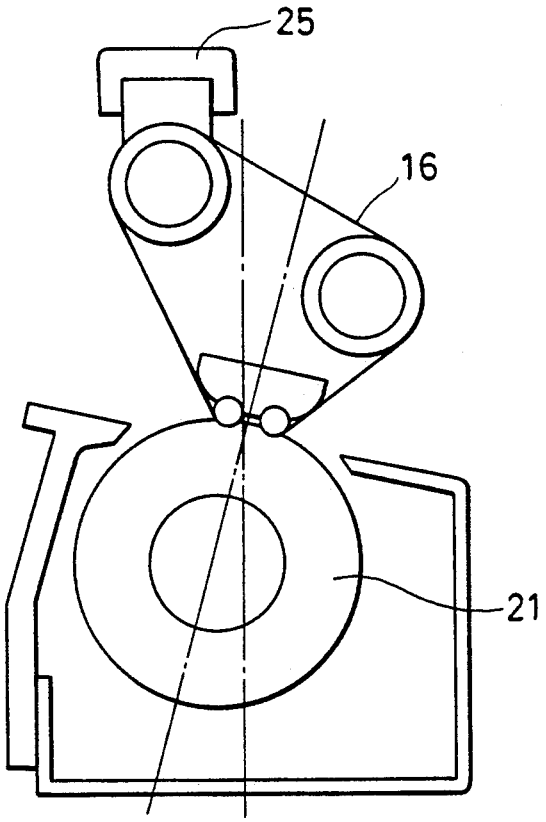
FIG. 6 is a schematic side elevational view of a fixing apparatus comprising another embodiment in which a fixing film is made into the form of an endless belt.

The fixing film 16 can also be made in the form of an endless belt, as shown in FIG. 6. In this case, the fixing film 16 may comprise a polyimide resin film having a thickness of 30 μm or thereabouts should be used as a base with carbon black added. Polymide resin film is recommended in view of its resistance to heat and its durability. Alternately, the used fixing film 16 taken up by the take-up roller may be rewound to the supply roller side at a suitable time, or the take-up roller side and the supply roller side may be inverted and interchanged, so that the fixing film can be used repeatedly. Reference numeral 25 denotes a felt pad with silicon oil impregnated in felt.

Figure 7:
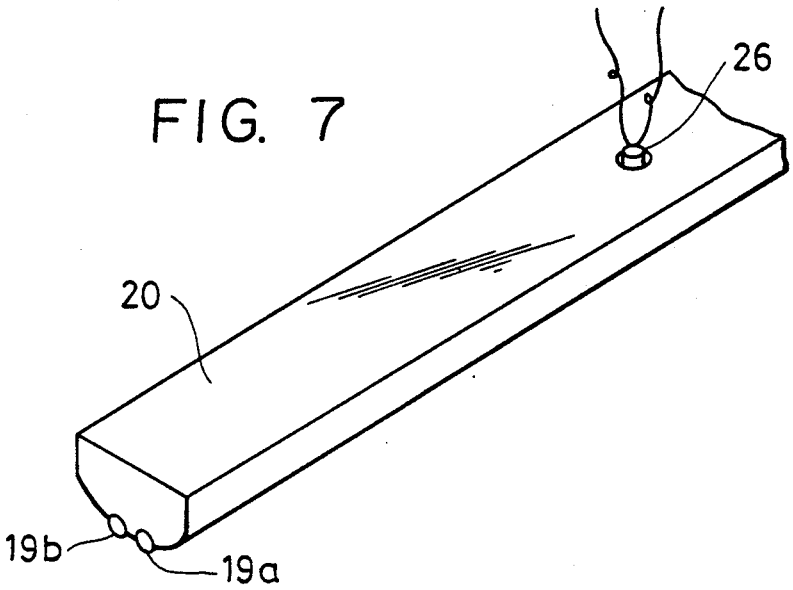
FIG. 7 is a perspective view of an electrode holder in which a thermister is incorporated.

Supply of electricity to the pair of electrodes 19a and 19b is also made possible by supplying electricity in the form of pulses rather than by an ordinary electrical conductance control so that the heat producing temperature of the fixing film 16 is kept constant. Further, as shown in FIG. 7, a temperature sensor 26, such as a thermister, is placed inside the electrode holder 20, and the heat producing temperature of the fixing film 16 can be controlled by the information from the temperature sensor 26.

As described above, according to this embodiment, since a film in contact with a toner image produces heat, and more particularly, produces heat only in the nip N, a very small thermal capacity is needed, and power savings and a shortened warm-up time can be achieved. Because the pair of electrodes are held rotatably, it is also possible to reduce electrode wear and decrease the required rotational torque of the whole fixing apparatus. Thus, it is possible to miniaturize the whole fixing apparatus, saving energy and lowering costs.

The above-described embodiment is very effective in shortening warm-up time and saving power. However, it is found that the relative width positional relationship among the electrodes 19a and 19b, the fixing film 16, and the pressing roller 21 as a pressing member in a direction at right angles to the direction in which a transfer material is transported, exerts an influence on the durable lifetime of the apparatus.

Next, an explanation for this influence on durability will be given. In the circumstance shown in FIG. 8(A), an electrode 42 directly contacts a pressing roller 40 in region A, and the rubber material of the pressing roller 40 deteriorates because of the current flowing through the electrodes. In addition, the electrical contact between the end surface of a fixing film and the electrodes becomes unstable in the A′ region which causes a large current flow through a part of the fixing film, resulting in an electrical deterioration of the fixing film.

Figure 8:
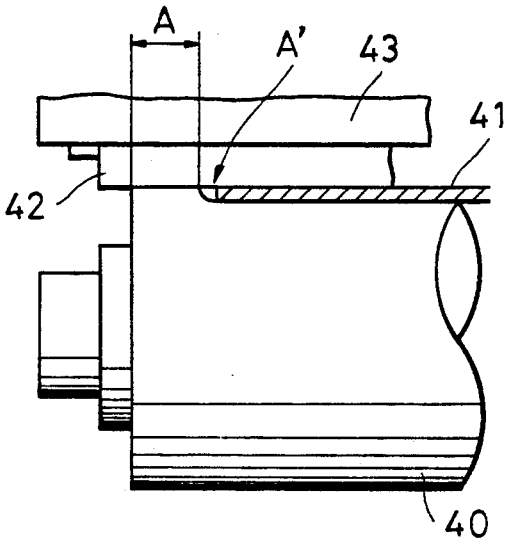
FIGS. 8(A) to 8(E) are cross sectional views each illustrating the relationship among an electrode, a fixing film, and a pressing roller.
Figure 8:
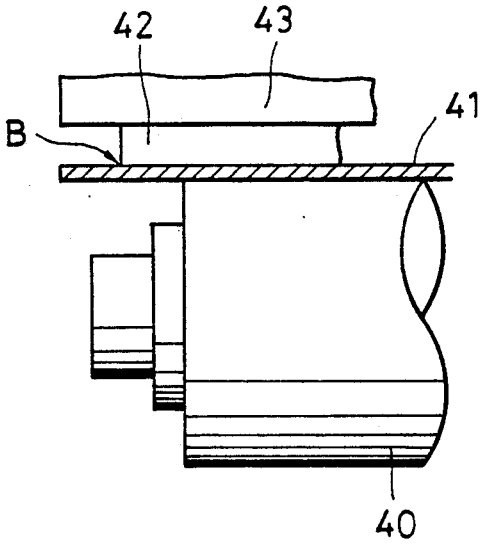
Figure 8C:
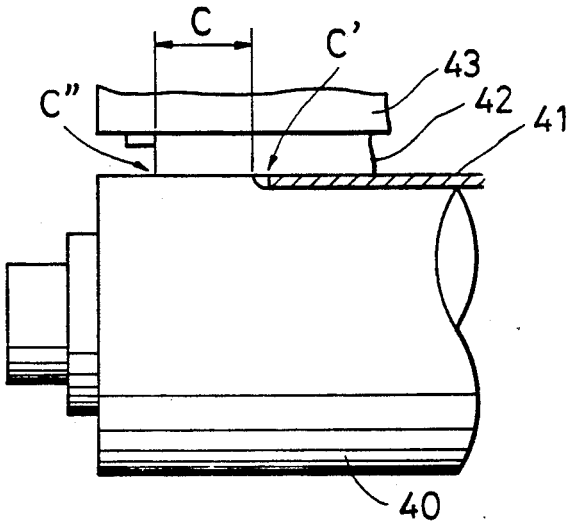
Figure 8D:
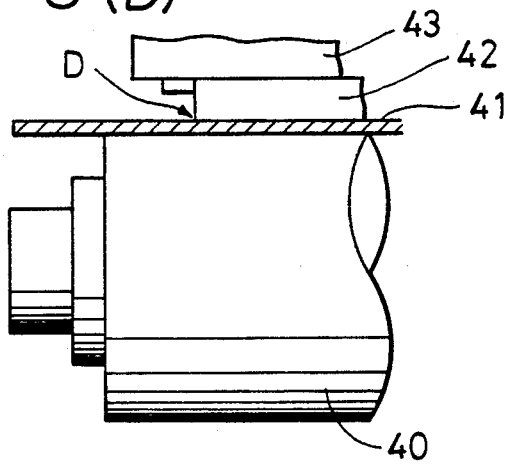
Figure 8E:
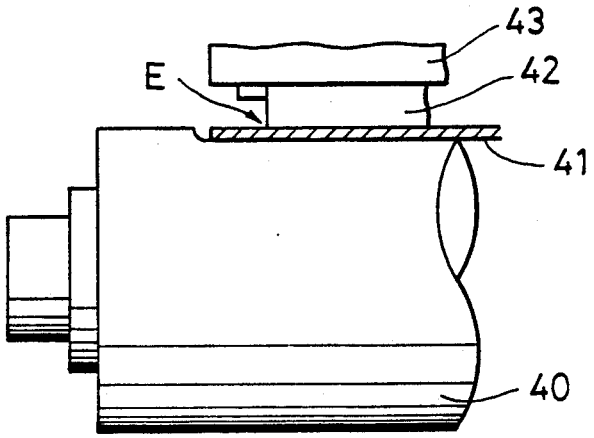

Next, in the system shown in FIG. 8(B), since the edge of the electrode 42 is brought into abuttment with the fixing film 41 in the B region, the fixing film 41 deteriorates mechanically. In the system shown in FIG. 8(C), the same thing as that in FIG. 8(A) occurs in the C′ region, and the pressing roller 40 deteriorates mechanically in the C″ region. In the system shown in FIG. 8(D), since the fixing film 41 is brought into contact with the edge of the electrode 42, the fixing film 41 deteriorates mechanically and electrically in the D region. In the system shown in FIG. 8(E), for the same reason as that in the system shown in FIG.8(D), the fixing film 41 deteriorates mechanically and electrically in the E region.

Figure 9:
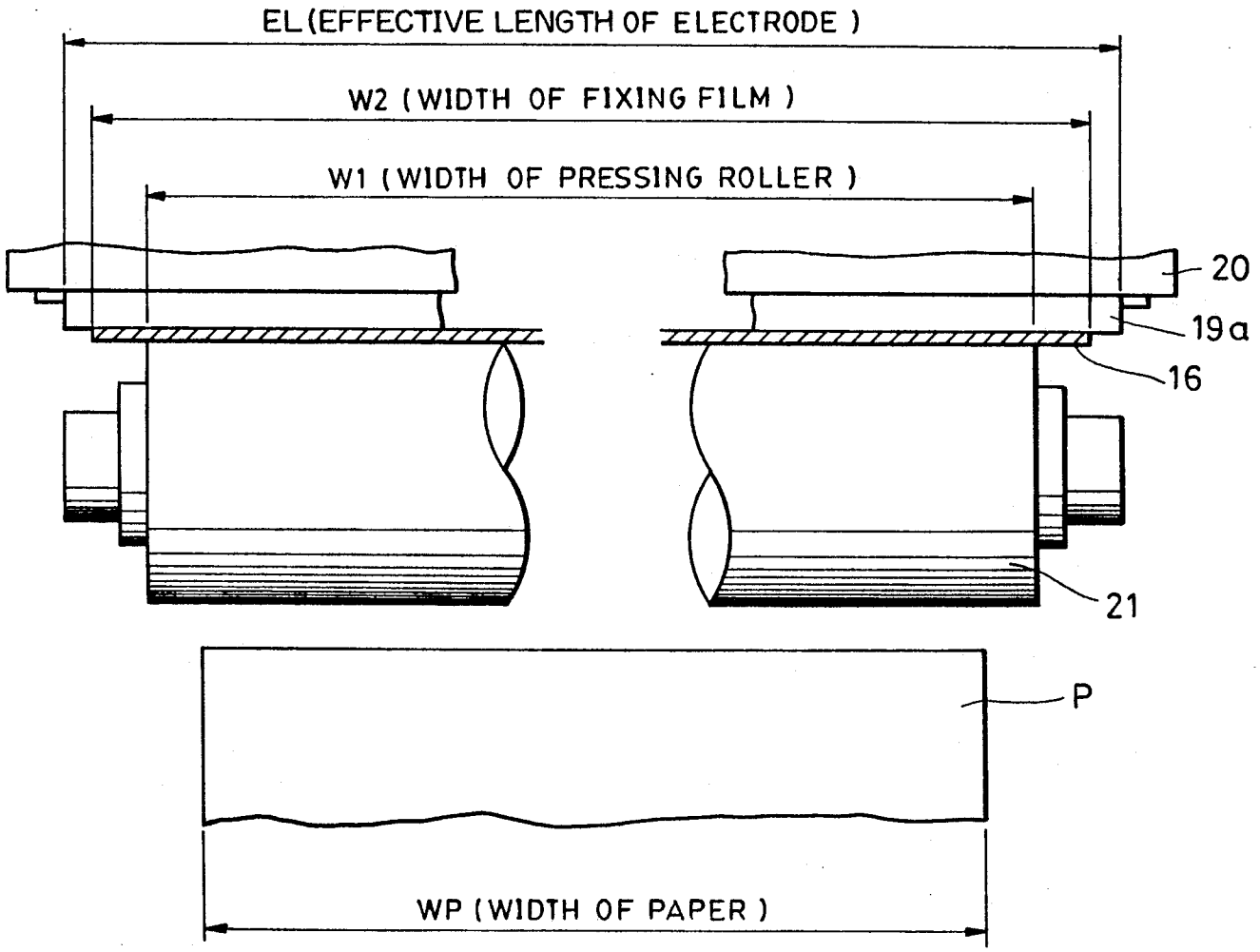
FIG. 9 is a view showing the dimensional relationship among the relative widths of an electrode, a fixing film, and a pressing roller in a still further embodiment of the present invention.

Next, an embodiment in which the above problems are solved and no deterioration occurs for a longer period of time will be explained. This embodiment is shown in FIG. 9. The apparatus shown in FIG. 9 is the same as the fixing apparatus shown in FIGS. 1 and 2 except for the relative width of the electrodes 19*a* and 19*b*, the fixing film 16, and the pressing roller 21 in the longitudinal direction of the nip N.

As shown in FIG. 9, in the fixing apparatus of this embodiment, the length of the electrodes 19*a* and 19*b* is greater in the longitudinal direction of the nip N than the width of the fixing film 16 which is itself wider than the width the pressing roller 21.

Since the pair of electrodes 19*a* and 19*b* are not brought into contact with the pressing roller 21, the deterioration of the pressing roller 21 is prevented. Also, since the entire width of the fixing film 16 is brought into contact with the effective portion of the pair of electrodes 19*a* and 19*b*, the electrical and mechanical deterioration of the fixing film can be prevented.

EL is an effective electrode length dimension of the electrodes 19*a* and 19*b*, which is set at 330 mm in this embodiment. W2 is a width dimension of the fixing film 16, which is set at 320 mm in this embodiment. W1 is a width dimension of the pressing roller 21 which is a pressing means, the width of which is set at 310 mm in this embodiment. WP is a paper width dimension of the maximum paper size in this embodiment, which is approximately 297 mm.

In an actual fixing operation, the picture image formation apparatus performs a picture-image formation operation in accordance with a picture-image formation start signal, and the transfer material P with a non-fixed toner image Ta carried on the top surface is transported a required distance from the transfer section 24 to the fixing apparatus 12. When the front end of the transfer material P reaches a predetermined position, e.g., approximately 15 mm in the front of the fixing apparatus, transport of the fixing film 16 begins and the supply of power begins between electrodes 19*a* and 19*b* commences.

Fixing can be accomplished while minimizing toner offset to the fixing film 16, by pressing against the fixing film 16 a felt pad impregnated with silicon oil having a viscosity of approximately 10,000 cst. In this embodiment, the fixing film 16 can also be made in the form of an endless belt, as shown in the embodiment of FIG. 6.

Figure 10:
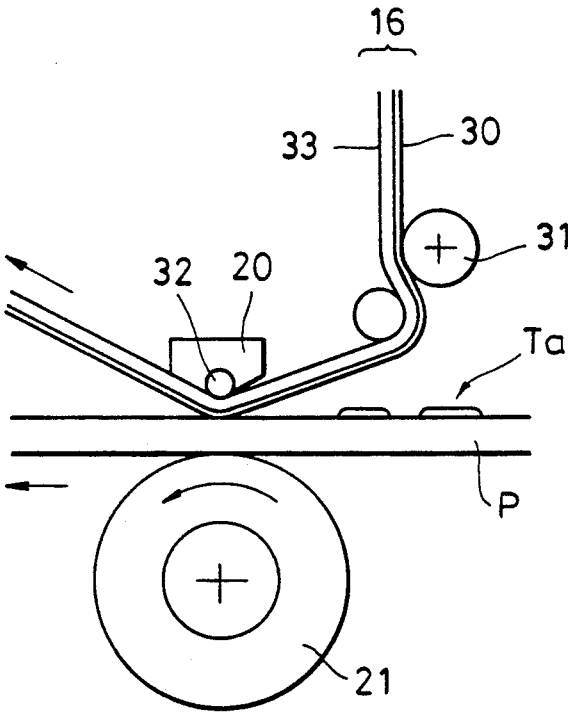
FIG. 10 is a cross sectional view of a still further embodiment of the present invention.

The arrangement for the fixing film 16 and the electrodes may be made as shown in FIG. 10. That is, the fixing film 16 may be formed as described below. Carbon black is added to a polycarbonate to form the base film 33 as in this embodiment. A thin-film conductive layer 30 made by aluminum deposition or the like is disposed on the side of the base film that will contact the transfer material on which a picture image is carried. Power is supplied between a first electrode 31 and a second electrode 32. Joule heat is produced in the thickness direction of the fixing film 16.

As has been explained above, as a picture-image formation apparatus to which the fixing apparatus of the embodiments of the present invention can be applied, an electrophotographic printer was explained. However, the present invention can also be applied to a picture-image formation apparatus such as copiers and electrostatic recording printers.

Many widely different embodiments of the present invention can be made without departing from the spirit and scope thereof, therefore, it is to be understood that this invention is not limited to the specific embodiments thereof except as defined in the appended claims.

What is claimed is:

1. A fixing apparatus, comprising:

an electrically conductive film adapted to move along with a recording material containing an unfixed image thereon;

a pressing member that presses against said film and forms a nip therebetween;

a plurality of electrodes disposed in a direction longitudinal to the nip, and contacting said electrically conductive film;

wherein said electrically conductive film generates heat by current flowing between the contacting portions of said electrodes through said electrically conductive film; and wherein the unfixed image on the recording material is heated and fixed by the heat generated by said electrically conductive film.

2. A fixing apparatus according to claim 1, wherein said electrically conductive film has a volume resistivity value of 20 to 200Ω·cm.

3. A fixing apparatus according to claim 1, wherein said electrically conductive film has a surface resistance value of 200 to 1000Ω.

4. A fixing apparatus according to claim 1, wherein said electrically conductive film includes a carbon black additive.

5. A fixing apparatus according to claim 1, wherein the said plurality of said electrodes are disposed within the width of the nip.

6. A fixing apparatus according to claim 1, wherein said pressing member is a roller having a rubber elastic layer.

7. A fixing apparatus, comprising:

an electrically conductive film that moves along with a recording material containing an unfixed image thereon;

a plurality of electrodes for supplying electricity to said film, thereby causing said film to generate and emit heat to heat and fix the unfixed image on the recording material, each of said electrodes having an elongated rotary body that is rotatingly mounted so as to rotate together with said conductive film as it moves along with the recording material.

8. A fixing apparatus according to claim 7, wherein said electrically conductive film has a volume resistivity value of 20 to 200Ω·cm.

9. A fixing apparatus according to claim 8, wherein said electrically conductive film has a surface resistance value of 200 to 1000Ω.

10. A fixing apparatus according to claim 7, wherein said electrically conductive film includes a carbon black additive.

11. A fixing apparatus according to claim 7, wherein said apparatus further includes a pressing member that presses against said electrically conductive film to form a nip, and wherein said electrodes are disposed within the width of the nip.

12. A fixing apparatus according to claim 7, wherein movement of said film rotates said electrodes.

13. A fixing apparatus comprising:

an electrically conductive film that moves along with a recording material, said film having a predetermined width W2;

a pressing member that presses against film and forms a nip therebetween, said pressing member having a predetermined width W1;

a plurality of electrodes disposed in the longitudinal direction of the nip within the width of the nip, said electrodes having a predetermined effective length EL in the longitudinal direction and supplying electricity to said film, wherein a recording material on which an image is held is heated and fixed by the heat from said film while the recording material is grasped between said film and said pressing member and transported, and wherein $W1<W2<EL$.

14. A fixing apparatus as claimed in claim 13, wherein the recording material has a predetermined maximum width denoted as WP in the longitudinal direction of the nip, and $WP<W1$.

15. A fixing apparatus according to claim 13, wherein the said electrically conductive film has a volume resisitvity value of 20 to 200Ω·cm.

16. A fixing apparatus according to claim 15, wherein said electrically conductive film has a surface resistance value of 200 to 1000Ω.

17. A apparatus according to claim 13, wherein said resistance value electrically conductive film includes a carbon black additive.

18. A fixing apparatus according to claim 13, wherein said pressing member is a roller having a rubber elastic layer.

19. A fixing apparatus according to claim 13, wherein said electrodes are rotatingly mounted so as to rotate together with movement of said film.

20. A fixing apparatus according to claim 13, wherein two of said electrodes form a region therebetween, and wherein the region in between said electrodes generates heat for said film.

* * * * *

UNITED STATES PATENT AND TRADEMARK OFFICE

CERTIFICATE OF CORRECTION

PATENT NO. : 5,084,738

DATED : January 28, 1992

INVENTOR(S) : Noriyoshi ISHIKAWA

It is certified that error appears in the above-identified patent and that said Letters Patent is hereby corrected as shown below:

ON THE COVER PAGE

AT [56] References Cited

U.S. PATENT DOCUMENTS

Insert --4,566,779 1/1986 Coli et al. . . . 355/212.

COLUMN 2

Line 42, "cross sectional" should read --cross-sectional--.
Line 49, "cross sectional" should read --cross-sectional--.
Line 57, "cross sectional" should read --cross-sectional--.

COLUMN 3

Line 33, "above," should read --above--.
Line 58, "rod shaped" should read --rod-shaped--.
Line 62, "powder" should read --power--.

UNITED STATES PATENT AND TRADEMARK OFFICE

CERTIFICATE OF CORRECTION

PATENT NO. : 5,084,738

DATED : January 28, 1992

INVENTOR(S) : Noriyoshi ISHIKAWA

It is certified that error appears in the above-identified patent and that said Letters Patent is hereby corrected as shown below:

COLUMN 4

Line 5, "powder" should read --power--;
Line 46, "selfheat-producing" should read --self-heat-producing--.
Line 65, "electricalconductance" should read --electrical-conductance--.

COLUMN 5

Line 2, "electricalconductance" should read --electrical-conductance--.
Line 3, "suppy" should read --supply--.

COLUMN 6

Line 11, "Polymide" should read --Polyimide--.
Line 59, "abuttment" should read --abutment--.

COLUMN 7

Line 47, "accomplished" should read --accomplished,--.

UNITED STATES PATENT AND TRADEMARK OFFICE

CERTIFICATE OF CORRECTION

PATENT NO. : 5,084,738

DATED : January 28, 1992

INVENTOR(S) : Noriyoshi ISHIKAWA

It is certified that error appears in the above-identified patent and that said Letters Patent is hereby corrected as shown below:

COLUMN 8

Line 14, "therebetween;" should read --therebetween; and--;
Line 34, "said" (second occurrence) should be deleted; and
Line 42, "thereon;" should read --thereon; and--.

COLUMN 9

Line 4, "against film" should read --against said film--; and
Line 6, "width W1;" should read --width W1; and--.

COLUMN 10

Line 2, "resi-" should read --resistivity--;
Line 3, "sitvity" should be deleted;
Line 7, "apparatus" should read --fixing apparatus--; and
Line 8, "resistance value" should be deleted.

Signed and Sealed this

Twenty-seventh Day of March, 2001

Nicholas P. Godici

*Attest:*

NICHOLAS P. GODICI

*Attesting Officer*

*Acting Director of the United States Patent and Trademark Office*